US009745710B2

(12) United States Patent
Hargrave et al.

(10) Patent No.: US 9,745,710 B2
(45) Date of Patent: Aug. 29, 2017

(54) CONVERTIBLE CAPPING SYSTEM FOR SHEET PILING WALL

(71) Applicant: CMI LIMITED CO., Marietta, GA (US)

(72) Inventors: Steve Hargrave, Roswell, GA (US); Ben Brown, Atlanta, GA (US)

(73) Assignee: CMI LIMITED CO., Marietta, GA (US)

( * ) Notice: Subject to any disclaimer, the term of this patent is extended or adjusted under 35 U.S.C. 154(b) by 11 days.

(21) Appl. No.: 15/096,947

(22) Filed: Apr. 12, 2016

(65) Prior Publication Data

US 2016/0305083 A1 Oct. 20, 2016

Related U.S. Application Data

(60) Provisional application No. 62/148,298, filed on Apr. 16, 2015.

(51) Int. Cl.
*E02D 5/03* (2006.01)
*E02B 3/06* (2006.01)

(52) U.S. Cl.
CPC . *E02D 5/03* (2013.01); *E02B 3/06* (2013.01)

(58) Field of Classification Search
CPC ..... E02D 5/03; E02D 5/16; E02D 5/223
See application file for complete search history.

(56) References Cited

U.S. PATENT DOCUMENTS 3,802,140 A * 4/1974 Hickman ..... E04D 3/405 52/300
4,083,158 A * 4/1978 Wolma ..... E04D 3/405 52/300
4,260,296 A 4/1981 Hilfiker
4,690,588 A * 9/1987 Berger ..... E02B 3/066 405/262
4,891,922 A * 1/1990 Hozer ..... E04B 2/7422 160/135
4,926,595 A 5/1990 Dean, Jr.
5,070,666 A * 12/1991 Looman ..... A47G 5/00 52/135
5,239,791 A 8/1993 Mills, Jr. et al.
5,584,610 A * 12/1996 Simpson ..... E02D 5/00 405/248

(Continued)

OTHER PUBLICATIONS

ArmorCap; Crane Materials; 2003; 1 pg.
EcoCap; The Pietrucha Group; 2006; 1 pg.

*Primary Examiner* — Benjamin Fiorello
(74) *Attorney, Agent, or Firm* — Gardner Groff Greenwald & Villanueva, PC

(57) ABSTRACT

A convertible capping system and methods of use thereof for capping a top portion of a sheet piling wall or other structure. A top panel of the capping system includes a widthwise spaced array of longitudinally extending parallel connection ribs, and defines an initial width at least equal to or greater than an intended final width, whereby a user can cut the top panel down to a desired final width corresponding to the thickness of the wall. A pair of side flanges have engagement features configured to attach to the connection ribs of the top panel after adjusting the width of the top panel, to assemble the capping system. A wave diverter and/or structural reinforcement system can optionally be provided with the convertible capping system or sheet piling wall.

41 Claims, 17 Drawing Sheets

(56) References Cited

U.S. PATENT DOCUMENTS

| | | | | |
|---|---|---|---|---|
| 5,772,185 | A | 6/1998 | Pulsipher | |
| 5,893,247 | A | 4/1999 | Hickman et al. | |
| 5,911,545 | A * | 6/1999 | Heitkamp | E02B 3/066 405/266 |
| 6,279,278 | B1 | 8/2001 | Morris et al. | |
| 6,893,191 | B2 | 5/2005 | Weyant et al. | |
| 7,059,807 | B2 * | 6/2006 | Irvine | E02B 3/066 405/262 |
| 8,046,962 | B2 | 11/2011 | Glick et al. | |
| 8,272,180 | B2 | 9/2012 | Glick et al. | |
| 2004/0013474 | A1 * | 1/2004 | Weyant | E02D 5/16 405/276 |
| 2007/0157533 | A1 | 7/2007 | Janesky et al. | |
| 2009/0188180 | A1 | 7/2009 | Irvine et al. | |

* cited by examiner

CONVERTIBLE CAPPING SYSTEM FOR SHEET PILING WALL

CROSS REFERENCE TO RELATED APPLICATION

This application claims priority to U.S. Provisional Patent Application Ser. No. 62/148,298 filed Apr. 16, 2015, which is hereby incorporated herein by reference in its entirety.

TECHNICAL FIELD

The present invention relates generally to wall structures constructed using barrier panels such as sheet pilings, which may be used to form barriers and other structures such as sea walls, piers, barrier walls, retaining walls, flood walls and the like. More particularly, the invention relates to systems, methods and associated components and materials for capping a top portion and open ends of such wall structures.

BACKGROUND

Structural panels such as sheet pilings are used to construct walls, barriers and other structures. For example, U.S. Pat. No. 7,025,539, which is incorporated herein by reference, shows a form of sheet pile used to create a barrier wall. In some applications, it has been found desirable to cap or cover the top of the structural panels forming a wall with a cap structure to provide a more aesthetically appealing structure and improve the finish and design of the project.

Typical capping materials such as formed aluminum capping panels are generally size-specific to walls of a particular depth or thickness. Thus, multiple different sizes of caps must be inventoried for projects having walls of different thicknesses. Additionally, many such products have minimum order quantities, often requiring a contractor to purchase more pieces than necessary, resulting in waste and economic inefficiency. And because different projects may utilize wall panels of differing colors and/or styles, it may not be possible to use excess materials from one project for another project. Furthermore, some walls may comprise one or more sections of different depths, leading to even more waste and economic inefficiency.

It is to the provision of a convertible capping system, and methods of use thereof, that the present invention is primarily directed.

SUMMARY

In example embodiments, the present invention provides a universal-fit convertible capping system for capping or covering a top portion of a sea wall, barrier wall, flood wall, retaining wall or other wall structure constructed of sheet pilings.

In one aspect, the present invention relates to a capping system for capping a top portion of a wall. The convertible capping system preferably includes a top panel having a top side and a bottom side. The bottom side preferably includes a plurality of engagement ribs. The capping system preferably further includes a pair of side flanges for coupling to the top panel, wherein the side flanges each include at least one engagement channel for engagement with the engagement ribs of the top panel.

In another aspect, the invention relates to a convertible capping system for capping a top portion of a plurality of interconnected sheet pilings, the plurality of interconnected sheet pilings having a first width, the convertible capping system including a panel having a generally rigid plate member including a top side and a bottom side, the top side optionally having a textured surface and the bottom side having a plurality of spaced apart ribs; and a pair of flanges for interengagement with the ribs of the panel, the flanges each including a leg portion, a radiused portion, and an arm portion, the arm portions having at least one interengagement channel for providing interengagement with at least one of the ribs of the panel. Preferably, a second width is defined between the leg portions of the flanges when the flanges are interengaged with the ribs of the panel, and wherein the second width is substantially similar to the first width of the sheet pilings.

In still another aspect, the invention relates to a wall barrier retention assembly including one or more sheet pilings generally coupled together to form a wall, and a convertible capping system for capping a top portion of the wall. The convertible capping system includes a top panel and a pair of side flanges, the top panel including a top side and a bottom side, the bottom side having a plurality of engagement ribs, and the pair of side flanges configured for coupling to the top panel, the side flanges each having at least one engagement channel for engagement with the engagement ribs of the bottom side of the top panel.

In example forms, the wall barrier retention assembly further includes a wave diverter for removable engagement with a portion of the convertible capping system. In some example forms, the wall barrier retention assembly includes a structural member and a fastening assembly for generally securing the wall with a dead man anchor that is generally buried or secured in a ground surface generally near the wall.

In still another aspect, the invention relates to a method of capping a top portion of a wall. The method preferably includes providing a top panel and a pair of side flanges, and coupling the pair of side flanges to the top panel to form a wall capping system having a width corresponding to a thickness of the wall. The method preferably further includes mounting the capping system to a top portion of the wall.

In another aspect, the invention relates to a method of using a convertible capping system for capping the top portion of a barrier wall including providing a convertible capping system having at least one panel and a pair of flanges; measuring the width of the barrier wall; cutting or trimming the at least one panel to be substantially similar in width to the width of the barrier wall; coupling the pair of flanges to the trimmed panel to form the convertible capping system; and coupling the convertible capping system to the top portion of the barrier wall.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of preferred embodiments of the invention, and are not restrictive of the invention, as claimed.

DETAILED DESCRIPTION OF EXAMPLE EMBODIMENTS

Figure 1:
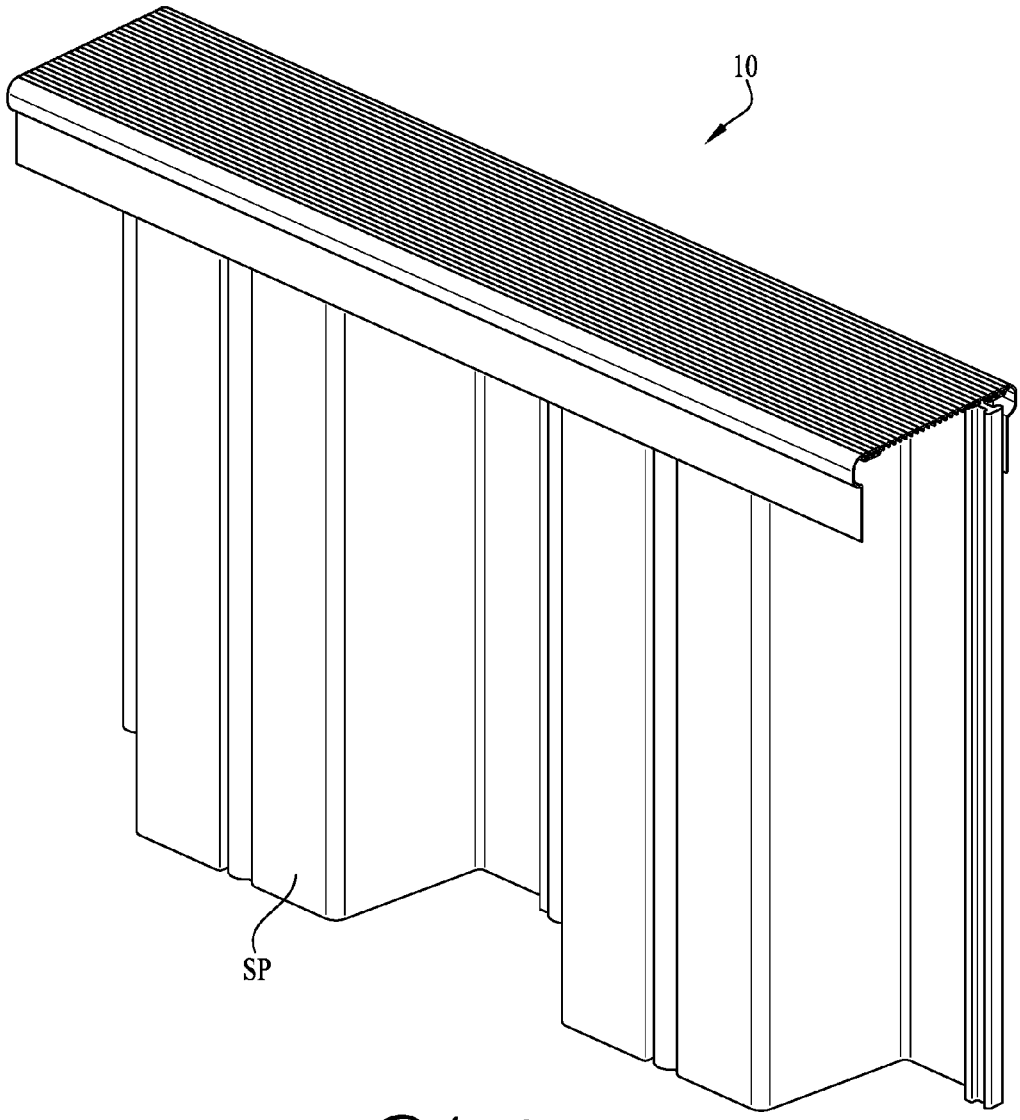
FIG. 1 is a perspective view of a convertible capping system mounted atop a wall structure formed of sheet piling panels, according to an example form of the invention.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-9 show a convertible capping system 10 for covering a top end or edge portion of a wall comprising a plurality of interconnected sheet piling panels SP according to an example embodiment of the present invention. In example embodiments, the sheet piling panels SP may optionally be in the form of sea walls, barrier walls, retaining walls, linear supports, barrier structures, other piling structures, or other supports or walls as desired.

Figure 2:
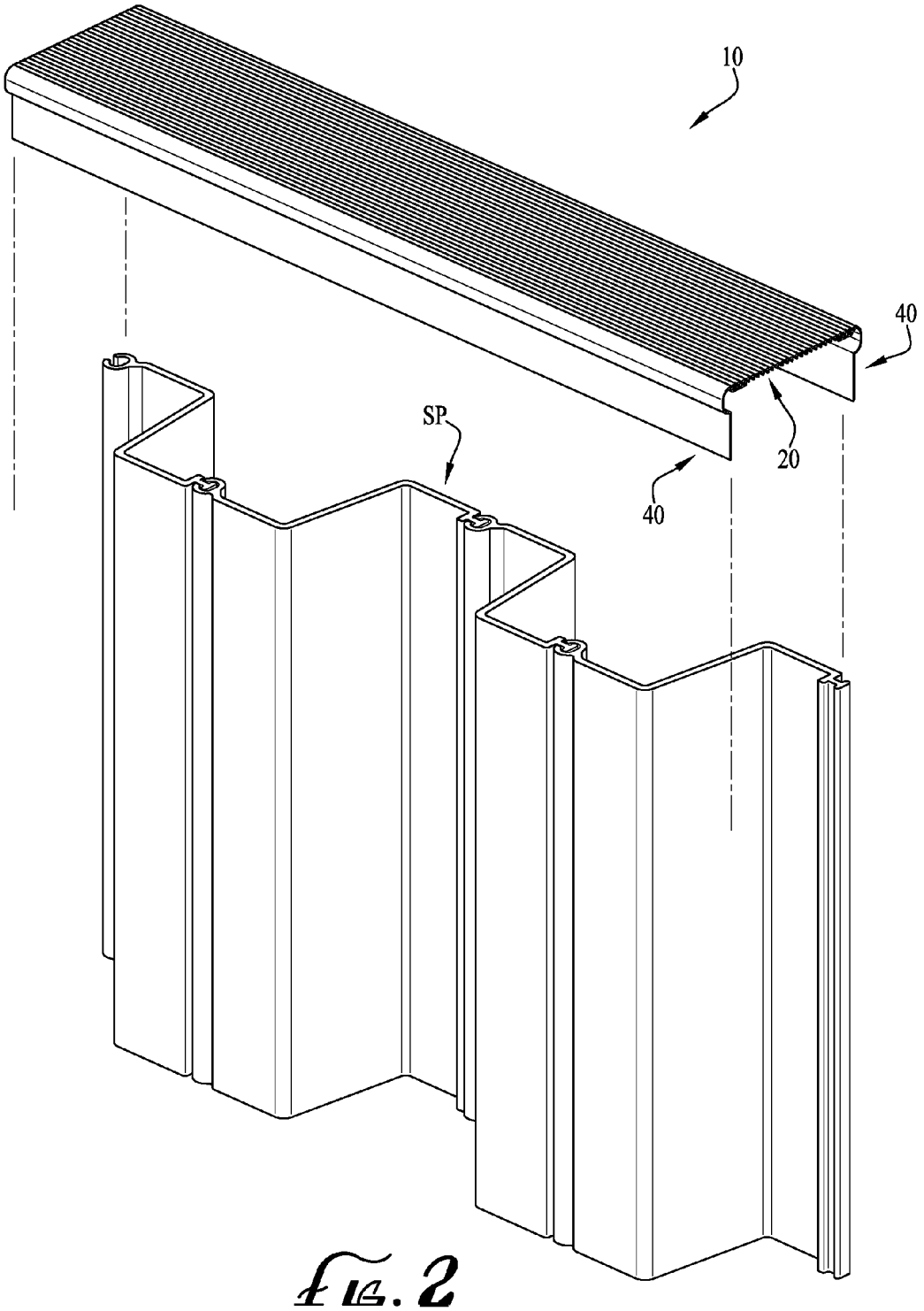
FIG. 2 is an assembly view of the convertible capping system of FIG. 1 separated from the plurality of interconnected sheet piling panels.

As depicted in FIG. 2, the convertible capping system 10 generally comprises a top panel 20, and first and second side flange members 40, for example, wherein the first and second side flange members 40 are generally removably engageable with opposed sides of the top panel 20 to form the capping system 10. Preferably, the top panel 20 can be trimmed by cutting to any selected width, such that capping system 10 is adjustable between at least two widths, for example, such that a portion thereof can be trimmed or cut along a length $L_P$ thereof (see FIG. 6) to provide at least two widths including a first width and a second width, for compatibility with walls of differing widths. In example embodiments, the top panel 20 can be cut to a desired width in the field, at a jobsite, using commonly available tools such as a saw, grinder, or sheet-metal brake. In example forms, the first width is defined by the width $W_P$ and the second width is defined by the width $W_{TP}$. The second width $W_{TP}$ is at least partially shorter than the first width $W_P$ and can vary as desired along a plurality of widths (dotted line indicates where along the width $W_P$ of the panel 20 can be trimmed). In example embodiments, one or more surface features are provided along the top and/or bottom surfaces of the top panel 20 extending in the lengthwise direction $L_P$, for use as reference lines or markings to assist in cutting the panel to a desired width. In example forms, the capping system 10 can generally removably mount to the top of the panels by frictional interengagement therebetween, or the capping system 10 may be removably or permanently mounted thereto with, for example, screws, rivets, fasteners, bolts, glue, adhesives, or other mounts, couplings, attachment means, etc., such as for example integral connection profiles, anchors, or the like. In example forms, the plurality of interconnected sheet pilings SP generally extend along a substantially linear path, and thus, the convertible capping system 10 is generally linear to match the path of the plurality of interconnected sheet pilings SP. Optionally, the plurality of interconnected sheet piling panels SP can be assembled having a curved path or profile or be shaped otherwise, and the convertible capping may be curved or shaped to extend along a path substantially similar to the path of the plurality of interconnected sheet pilings SP, which may be curved, angled or shaped as desired. For example, a straight cap member, a curved cap member, a right angled corner or transition cap member, a radiused transition cap member, and/or other cap configurations are within the scope of the invention.

Figure 3:
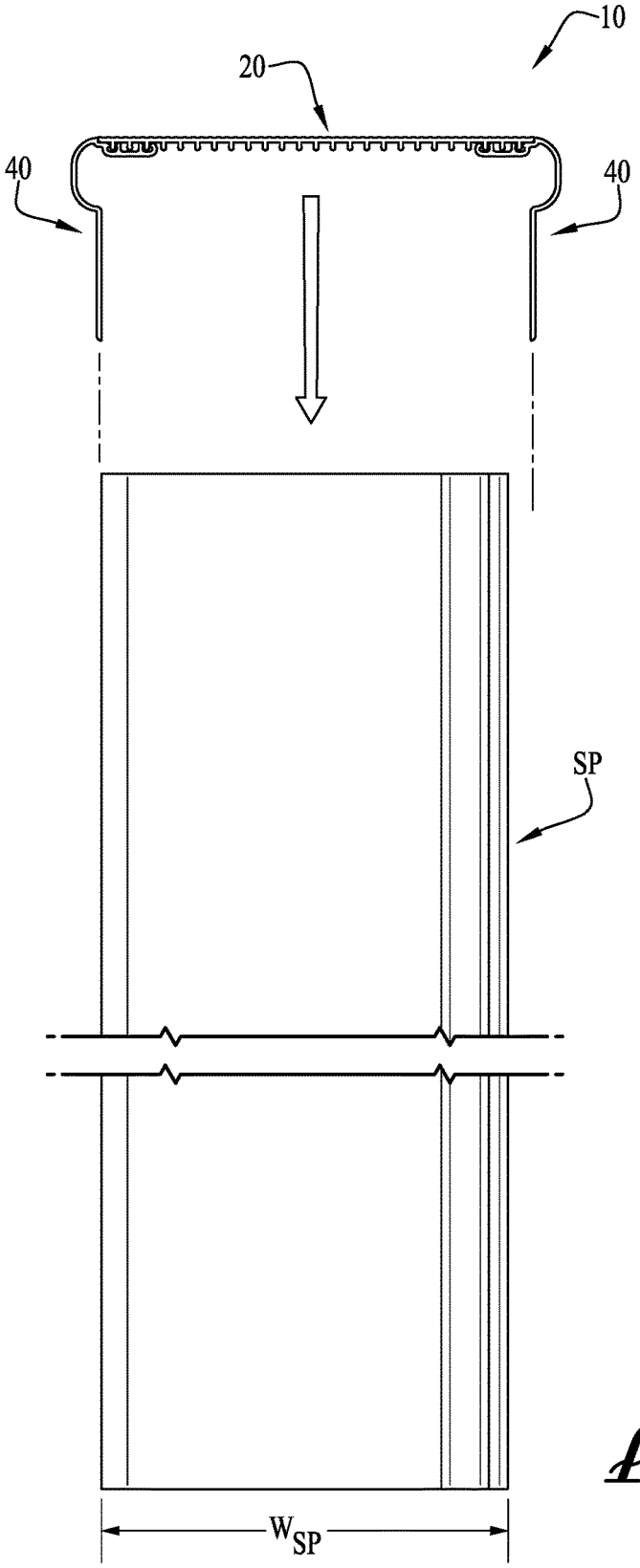
FIG. 3 is a side view of the convertible capping system of FIG. 2.

FIGS. 2-3 show the convertible capping system 10 and the wall of sheet pilings SP in assembly view, with the capping system generally spaced apart from the top end of the plurality of interconnected sheet pilings SP. In example forms, the sheet pilings SP comprise a width $W_{SP}$, which is generally between about 6-12 inches, but may optionally be between about 4-18 inches, or in some instances larger or smaller to suit particular applications. Preferably, the convertible capping system 10 (as will be described below) can be configured to accommodate removable or permanent engagement with the top end of the plurality of interconnected sheet pilings SP, for example, wherein the convertible capping system 10 can be adjusted or altered to define a range of widths of, for example, 4-18 inches, or more particularly about 6-12 inches, such that the capping system 10 can be used to cap/cover the sheet pilings SP comprising various different widths $W_{SP}$. In this manner, the capping system 10 provides a universal or convertible fit with walls of differing widths, whereby the user can fit the cap to any of a plurality of different wall sizes and/or configurations.

Figure 4:
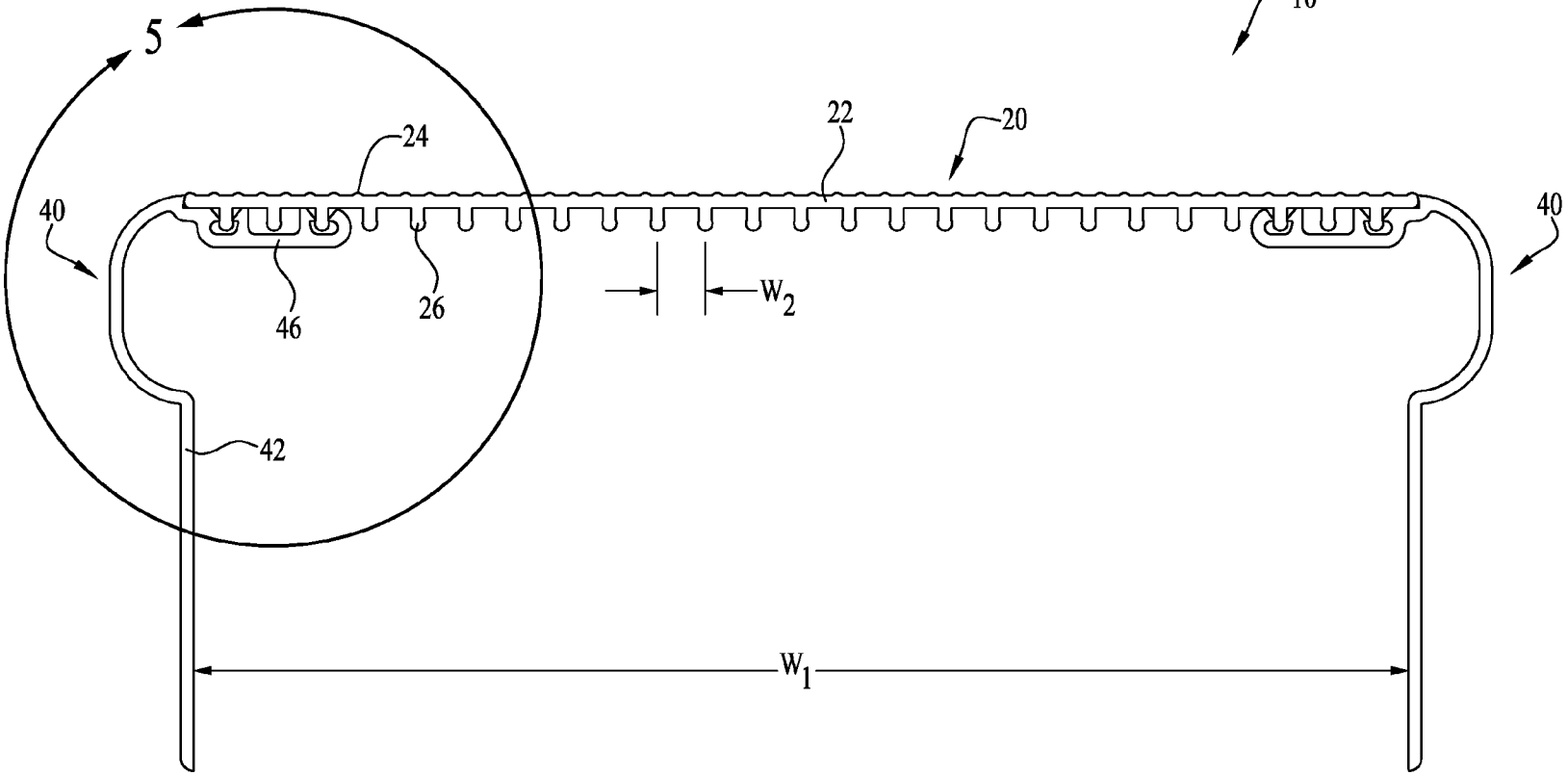
FIG. 4 is a close-up side view of the convertible capping system of FIG. 3.
Figure 5:
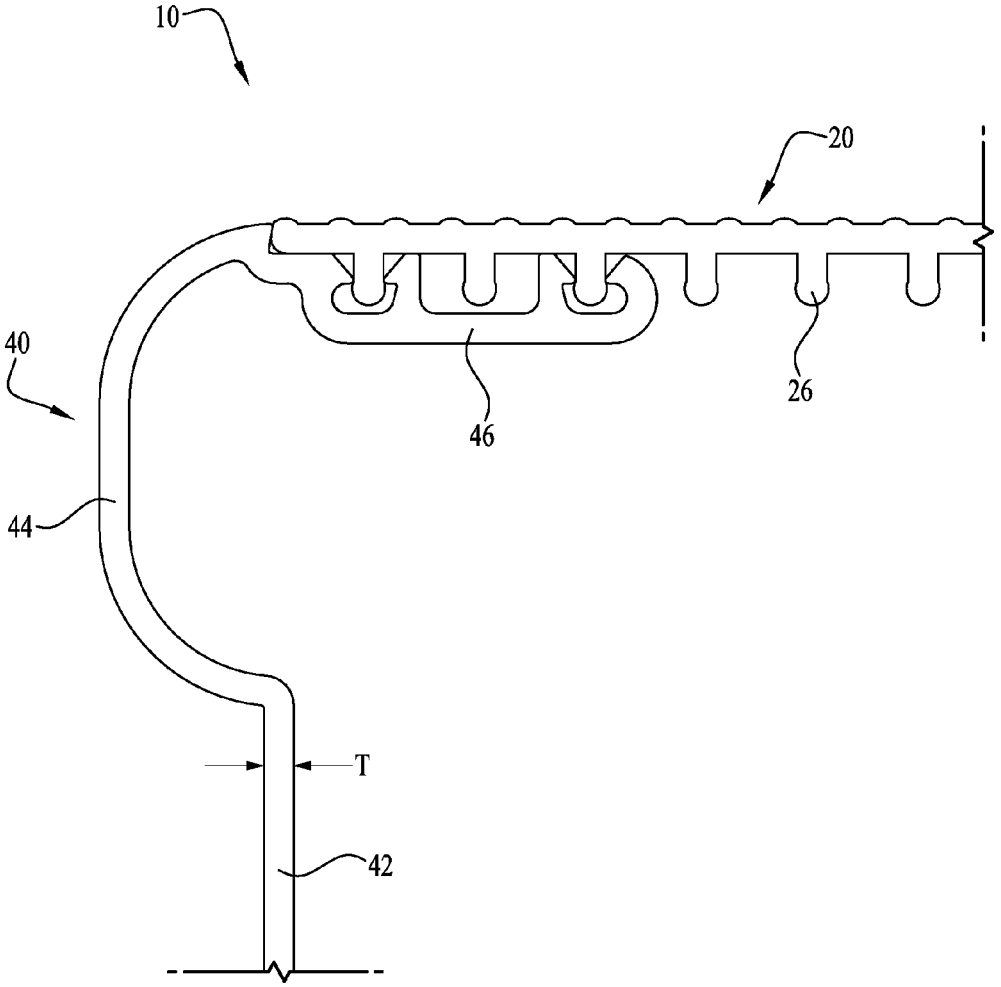
FIG. 5 is a detailed view of a joint or coupling portion of the convertible capping system of FIG. 4.
Figure 6:
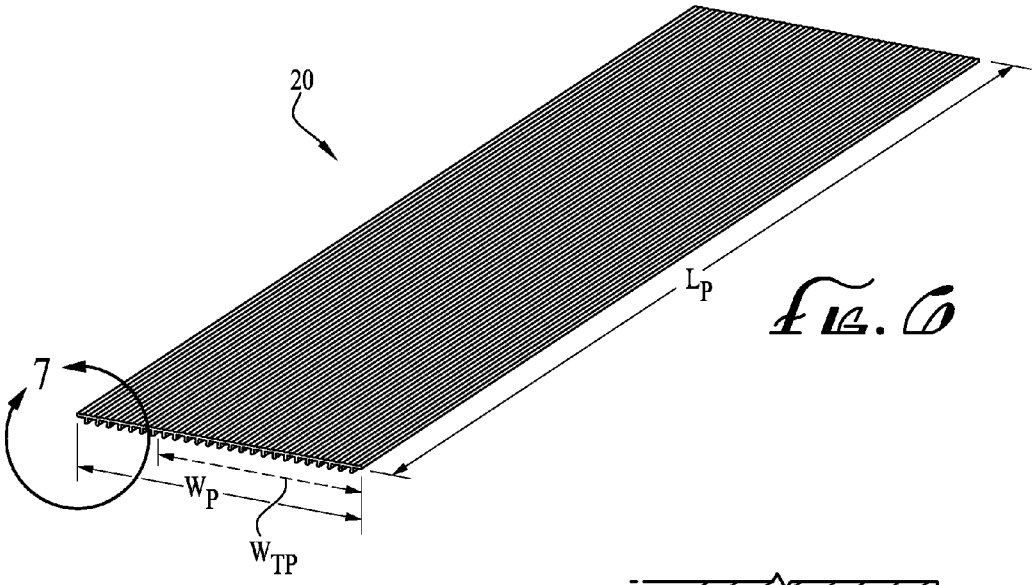
FIG. 6 is a top perspective view of a top panel of the convertible capping system of FIG. 4.
Figure 7:
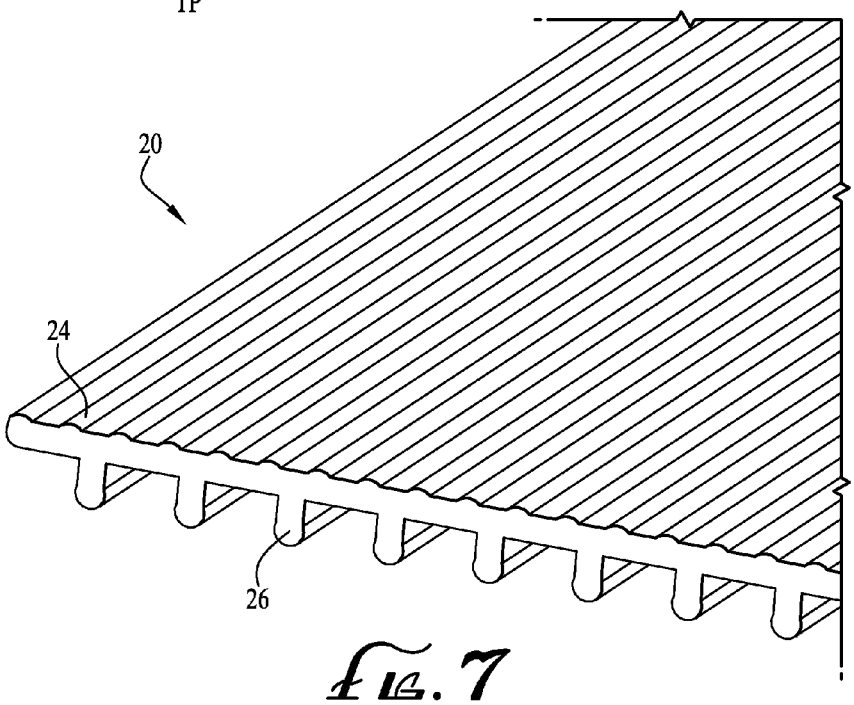
FIG. 7 is a detailed view of a portion of the panel of FIG. 6.
Figure 8:
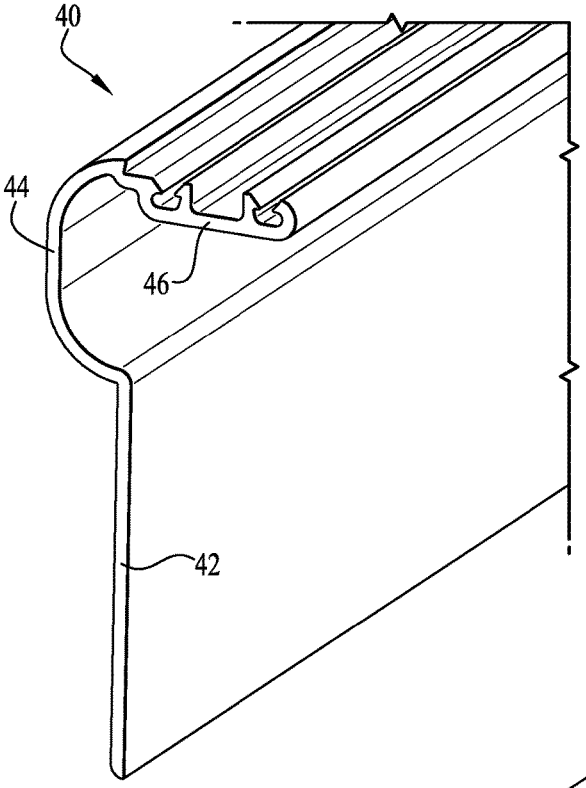
FIG. 8 is a perspective view of a portion of a side flange member of the convertible capping system of FIG. 4.

FIGS. 4-9 show the capping system 10 in greater detail. The top panel 20 comprises a generally rigid planar sheet or plate member 22 comprising a top side, a bottom side, a length $L_P$, a width $W_P$, and a thickness. In example forms, the top side comprises a textured non-slip surface, for example, a plurality of spaced-apart indents 24, and the bottom side comprises a plurality of spaced-apart interengagement features or ribs 26 arranged in an evenly-spaced parallel array. Typically, the width $W_P$ is generally between about 4-18 inches, more preferably about 6-12 inches, and the length $L_P$ is at least about 12 inches, more preferably at least about 72 inches or longer. In one example form, the width $W_P$ is generally about 13 inches, more preferably about 12.5 inches, and in a particular example about 12.879 inches wide according to an example embodiment of the present invention. And, as shown in FIGS. 6-7, the spaced-apart indents 24 and the ribs 26 preferably extend lengthwise along all or a substantial portion of the length L of the panel 20 and are generally evenly spaced across the width $W_P$. Optionally, the panel 20 may be configured with a thickness and structural rigidity sufficient to support the weight of one or more persons, for example, such that users can walk on top of the panel 20 when installed to cap a sheet piling wall. Preferably, the textured surface can be configured to prevent a user from slipping when walking thereon.

Referring to FIGS. 4-5, each of the side flange members 40 comprise a vertical leg or front panel portion 42, an outwardly-directed and generally C-shaped radiused bumper or wale 44, and a connection flange or arm 46 extending generally perpendicular or transverse relative to the leg portion 42. The left and right side flange members 40 are preferably identical and oriented to be mirror images of one another when assembled, for example, such that the same extrusion or molding profile can be used for both side flange members. Alternatively, different profiles can be used on opposite sides of the wall. As seen in the detailed view of FIG. 9, the connection arm 46 comprises a pair of interengagement or rib-receiving channels 50. The interengagement channels 50 of each arm 46 are correspondingly spaced to receive and couple with cooperating ribs 26 on the underside of the top plate 20 to construct the convertible capping system 10. In one example form, the first and third outermost ribs 26 of each side of the top plate member 20 are removably coupled to the pair of interengagement channels 50 of the arm 45 of each side flange 40 (see FIGS. 4-5). Preferably, interengagement of the ribs 26 with the interengagement channels 50 defines a width $W_1$ between the leg portions 42 of the flange members 40 (see FIG. 4) corresponding to the width of the wall to be capped. According to example forms, the width $W_1$ can be between at least about 6-12 inches, and in additional forms, the width can be between about 4-18 inches. Preferably, the width $W_1$ can be configured to be about equal to the width $W_{SP}$ of the wall of sheet pilings SP, or for example, at least about 0.5-1 inches greater than the width $W_{SP}$ of the sheet piling wall to provide clearance for ease of installation. Alternatively, the width $W_1$ can be about equal to or slightly less than the width $W_{SP}$ of the sheet piling wall, and sufficient resiliency or play in the connections and/or structure of the capping system provided to form a close frictional engagement of the capping system on the sheet piling wall.

Figure 9:
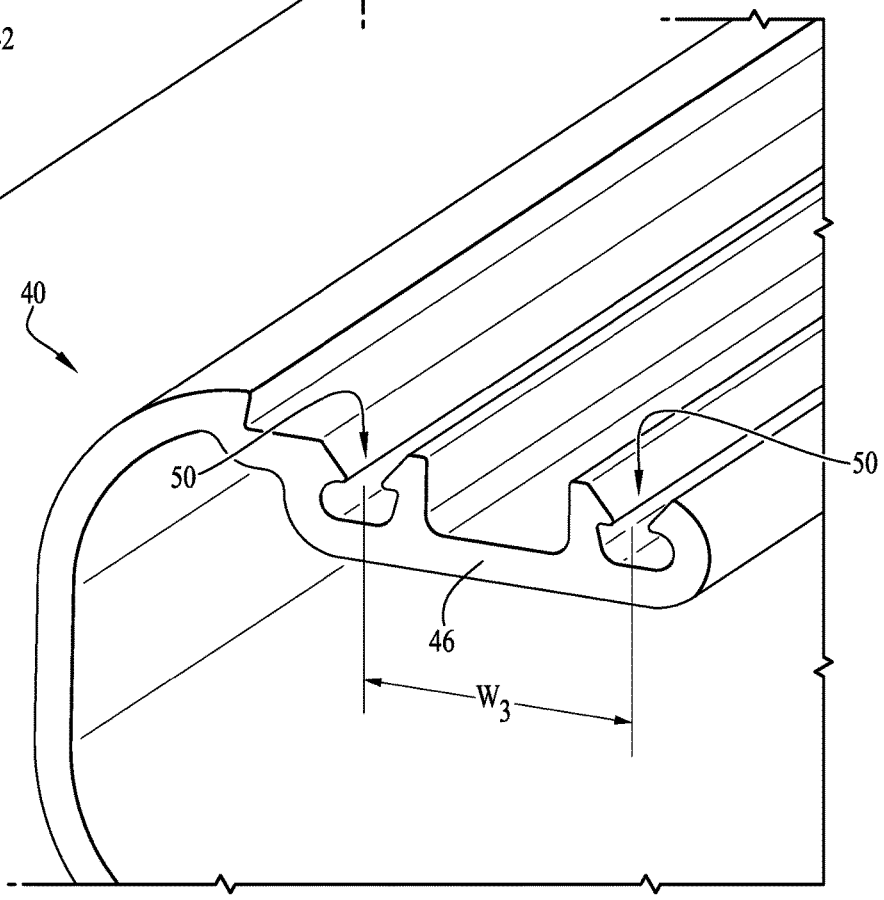
FIG. 9 is a detailed perspective view of a coupling portion of the flange member of FIG. 8.

With reference to FIG. 4, the ribs 26 are generally spaced apart along the bottom side of the plate 22 such that a width $W_2$ is generally defined therebetween (e.g., measured from center-to-center), and the interengagement channels 50 are preferably spaced-apart to define a width $W_3$ therebetween (see FIGS. 4, 9) that is approximately or substantially an even multiple of the width $W_2$. In example forms, the width $W_2$ is generally about 0.5 inches and the width $W_3$ is about 1 inch. Optionally, the widths $W_2$, $W_3$ can be configured as desired. Thus, as described above, the first and third most outer ribs 26 of each side of the plate 20 can be removably engaged with the interengagement channels 50 of the arms 46 of the flange members 40 (see FIGS. 4-5). In example forms, the interengagement channels 50 are at least partially resilient and flexible such that the ribs 26 generally clip or snap together (e.g., snap-fit) with the interengagement channels 50. As shown in FIGS. 7 and 9, a free end of each rib 26 preferably comprises an expanded radiused or bulbous male profile and the channels 50 preferably comprise a cooperative C-shaped female engagement profile configured to receive the male profile of a rib and positively engage its expanded bulbous profile. Typically, the C-shaped engagement feature comprises inwardly-inclined surfaces extending downwards to a point-like edge, for example, such that the radiused portions of the ribs 26 are free to engage the interengagement channels 50 (generally causing the channels to temporarily flex outwardly), and wherein once engagement is provided therebetween, the point-like edges of the C-shaped engagement feature generally prevent unintentional disengagement of the ribs 26 from the channels 50. Optionally, in other embodiments, the C-shaped engagement feature may be substantially rigid such that the ribs 26 slidingly engage (horizontal motion) the interengagement channels 50, rather than the snap-fit (vertical motion) engagement as described above. The interface between the outwardly-directed wale 44 and the connection arm 46 of the side flange members 40 preferably comprises a recessed channel having a depth generally matching the thickness of the top panel 20. Preferably, the exact dimensions and tolerances are generally configured for ease of installation and, for example, for preventing unintentional disassembly. Thus, preferably the dimensions of the top panel 20, ribs 26, flange members 40, channels 50, etc. are generally sized to accommodate coupling engagement therebetween while also not preventing disengagement therebetween when necessary.

The top panel 20 and side flanges 40 can be formed as an extrusion, by molding, casting, roll-forming, machining or otherwise, and may comprise polyvinyl chloride (PVC), polypropylene, polyethylene, ABS, nylon, steel, aluminum, and/or other plastics, metals or other materials and/or mixtures or composites thereof. The top panel 20 and side flanges 40 may be formed from the same or different colors. In example forms, the panel and flanges are extruded using a co-extrusion process. In one example form, panel 20 and flanges 40 are co-extruded to comprise a virgin PVC material external layer, and a recycled PVC material infill content. Typically, the panel 20 and flange members 40 comprise a material thickness T that is generally between about 0.0625-0.25 inches, more preferably about 0.130 inches. Optionally, other thicknesses T may be chosen as desired. The system 10 may be configured for capping a sea wall, pier, barrier wall, retaining wall, or other construction. Various colors, textures, patterns, surface treatments, coatings or the like are optionally applied to one or more components of the capping system.

In example modes of use of the capping system according to the present invention, the width of the top panel 20 can be manufactured and provided at a nominal initial width equal to or greater than the anticipated range of applications, and trimmed or cut along the length $L_P$ such that the width $W_1$ between the leg portions 42 can be adjusted to accommodate the width $W_{SP}$ of the wall of sheet pilings SP to be capped in a particular installation. For example, in an representative application, the width $W_{SP}$ is about 10 inches and the width $W_1$ between the leg portions is about 12 inches. Thus, the width $W_P$ of the panel 20 is preferably trimmed by about 2 inches (e.g., the width $W_{TP}$ is about 2 inches) such that when the panel 20 is coupled to the flanges 40, the width $W_1$ defined between the leg portions is about 10 inches, corresponding closely to the width of the wall to be capped. The trimming of the panel 20 to size may be performed with a cutting device such as a saw, and can be done on the job site, at the manufacturing site, by an intermediate service provider, or otherwise as desired. Alternatively, the capping system 10 can comprise a kit or set including a plurality of top panels 20 of differing widths, whereby a user selects a top panel having a width corresponding to the thickness of the wall to which the capping system is to be applied, and attaches the side flanges 40 to the selected top panel to form a capping system having a desired width.

Figure 10:
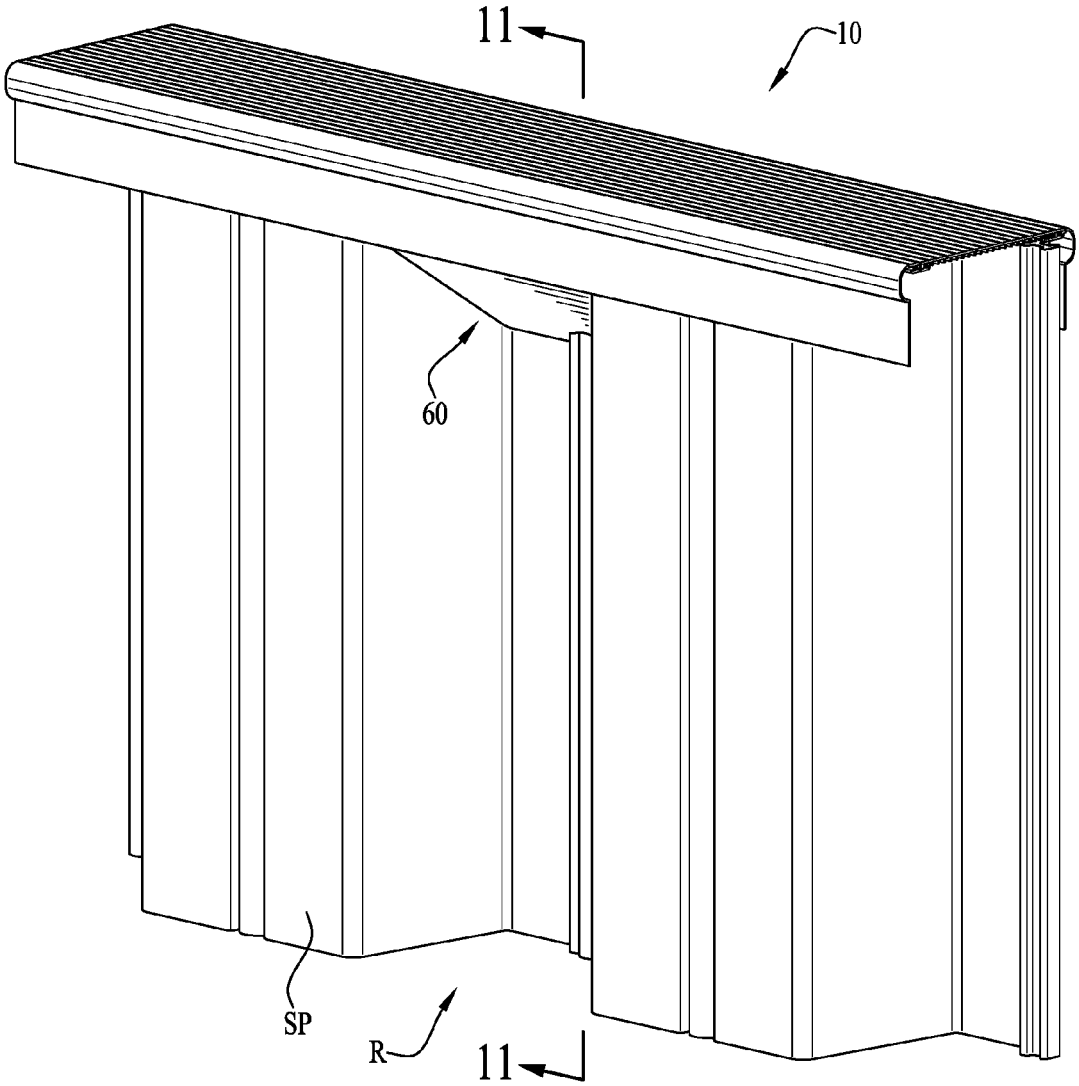
FIG. 10 is a perspective view of the convertible capping system mounted to the plurality of interconnected sheet piling panels of FIG. 1, further comprising a wave diverter according to an example embodiment of the present invention, and showing the wave diverter positioned within a recess of the sheet piling panels and beneath the capping.
Figure 11:
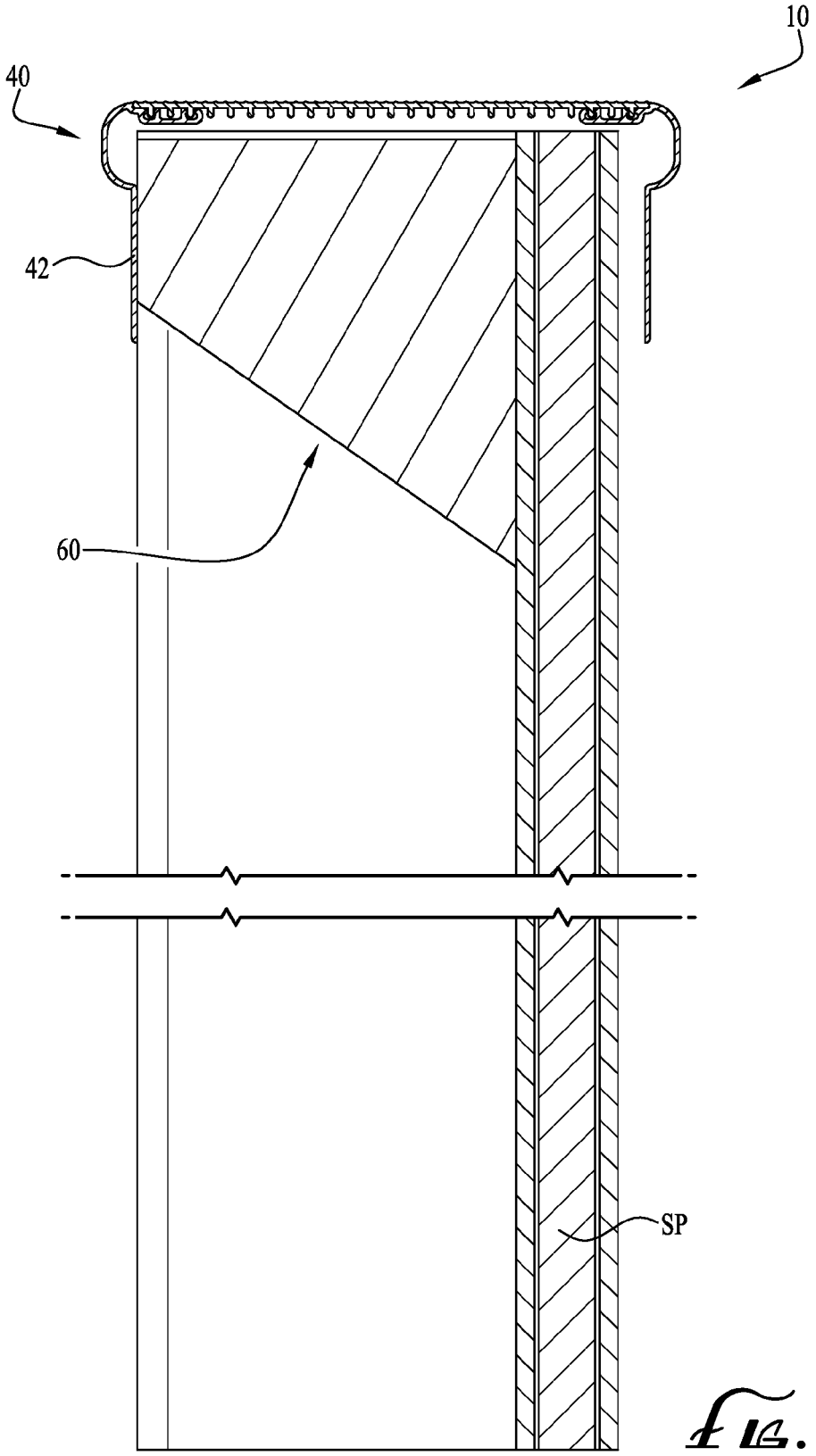
FIG. 11 shows a cross-sectional side view of the convertible capping system and wave diverter of FIG. 10 taken along line 11-11.
Figure 12:
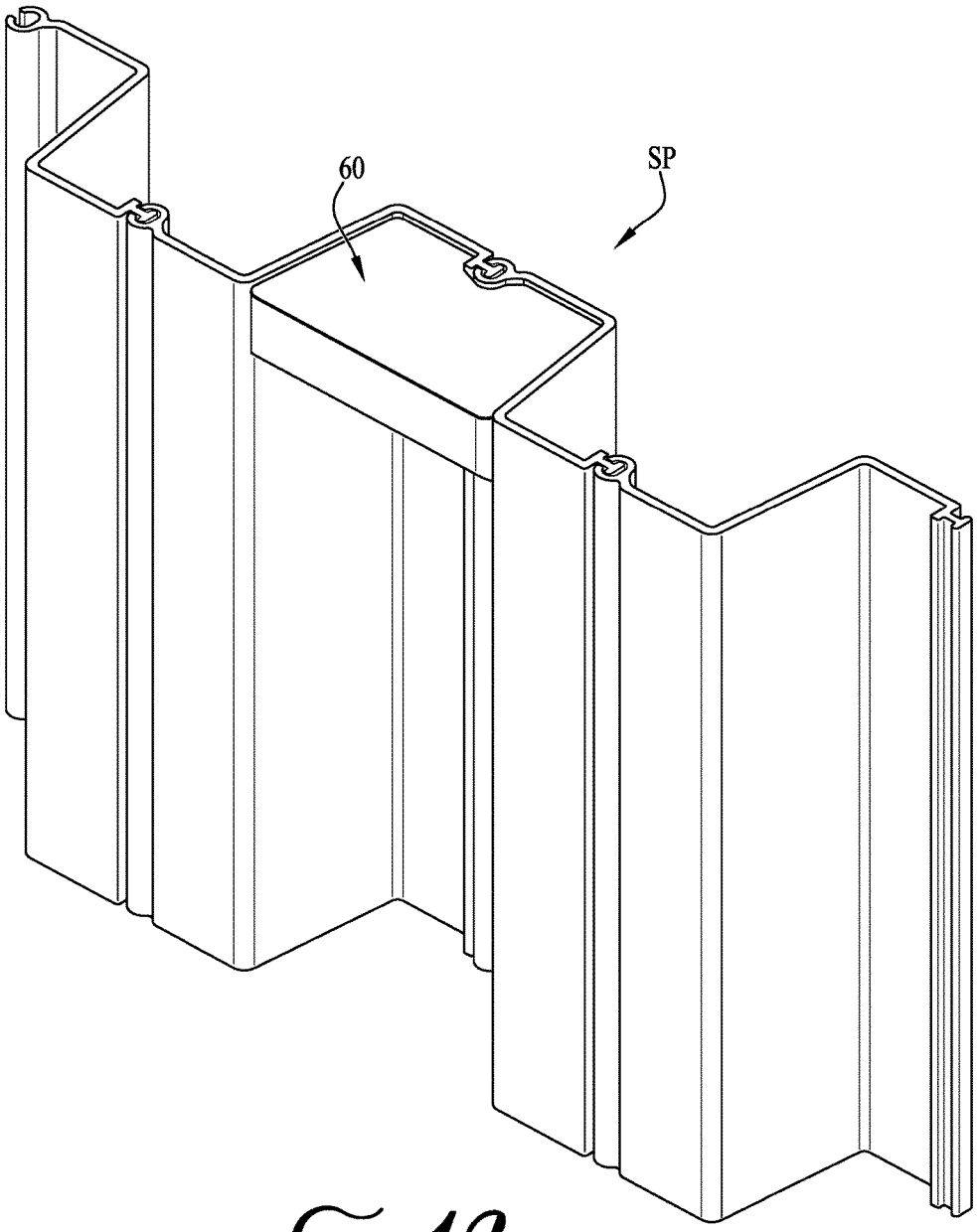
FIG. 12 shows the plurality of interconnected sheet piling panels of FIG. 10 with the wave diverter positioned within the recess.

FIGS. 10-15 show a wave blocking member or diverter 60 for use in connection with a sheet piling wall capping system, according to an example embodiment of the present invention. In example forms, the wave diverter 60 is preferably attached onto to the wall by engagement with the ribs 26 on the underside of the top plate 20 of the capping system 10, or alternatively by one or more couplings, fasteners or connectors. As shown in FIGS. 10-12, the wave diverter 60 preferably mounts along an exterior or outer face and within a recessed portion R of the sheet pilings SP, which is generally facing and in contact with a body of water or other large water mass. Preferably, the wave diverter 60 is configured to prevent waves, turbulent flows, or other forceful forms of water from being permitted to enter/contact an underside portion of the convertible capping system 10 (e.g., the bottom side of the plate member 22) and potentially detaching the capping system from the wall. In example forms, when installed, the wave diverter 60 presents a sloped or obliquely angled inclined contact face to redirect the flow or energy of a wave or water action acting upon the sheet piling wall away from the capping system.

Figure 13:
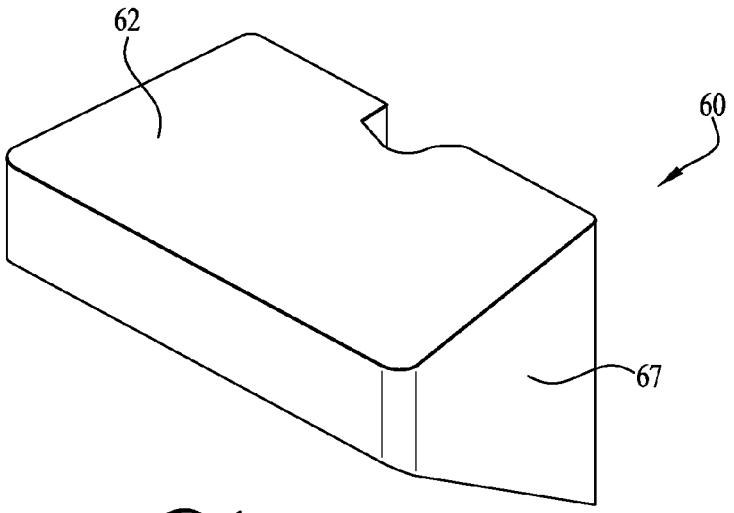
FIGS. 13-15 show additional views of the wave diverter of FIG. 10.
Figure 14:
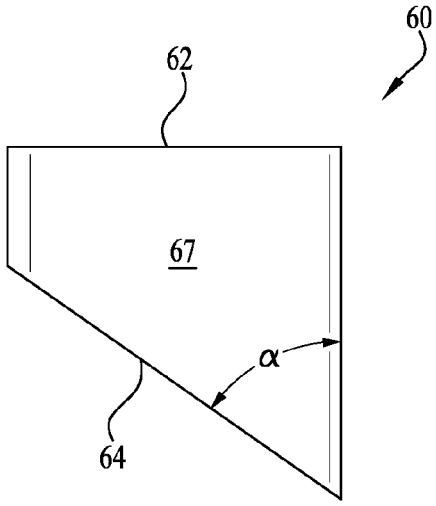
Figure 15:
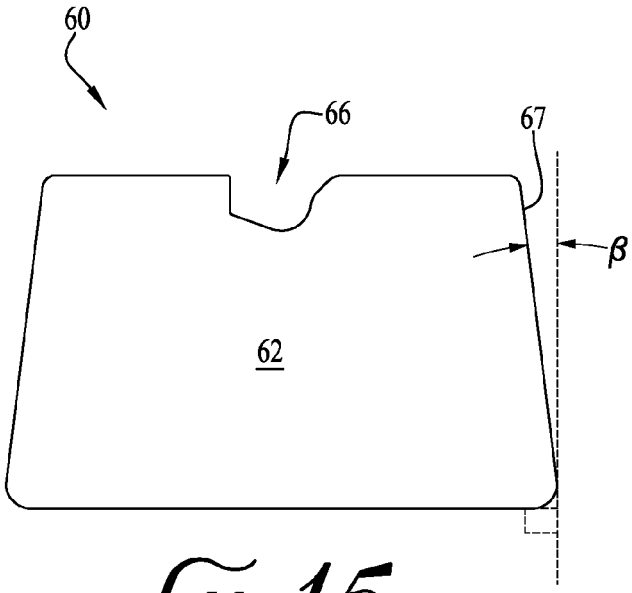

As depicted in FIGS. 13-15, in an example form the wave diverter 60 generally comprises a block-like body comprising a top face 62, a bottom angled face 64 defining an angle $\alpha$, a recessed channel 66, and side faces 67 defining an angle $\beta$. In example forms, the angle $\alpha$ is oblique or acute, for example generally between about 20-85 degrees, more preferably between about 30-75 degrees, and more preferably between about 50-60 degrees. The angle $\beta$ is generally between about 1-20 degrees, more preferably between about 5-10 degrees, and about 7 degrees according to one example form. Generally, the angle $\beta$ will be configured such that the side faces 67 are substantially similar and conforming to the walls of the recessed portion R of the sheet pilings SP when installed, which can generally be angled as desired. Generally, according to some example forms, the recessed channel 66 is configured to provide for clearance from a transition or connection portion of the sheet pilings SP, for example, a generally elongate rib defined by the connection of two adjacent sheet pilings SP.

Figure 16:
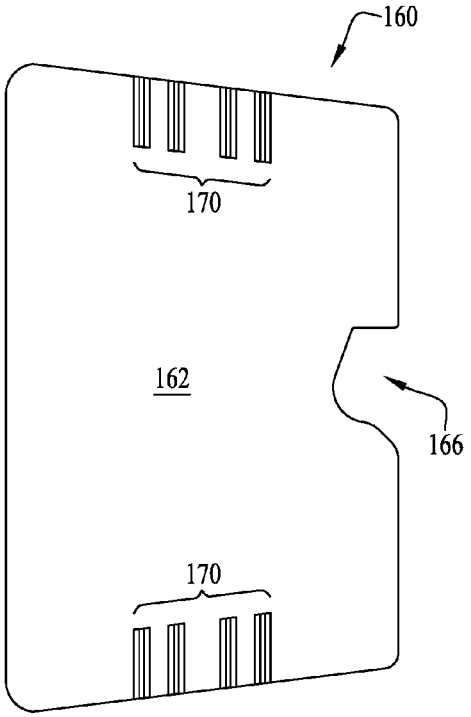
FIGS. 16-18 show a wave diverter according to another example embodiment, including engagement channels for removable engagement with a portion of the convertible capping system.
Figure 17:
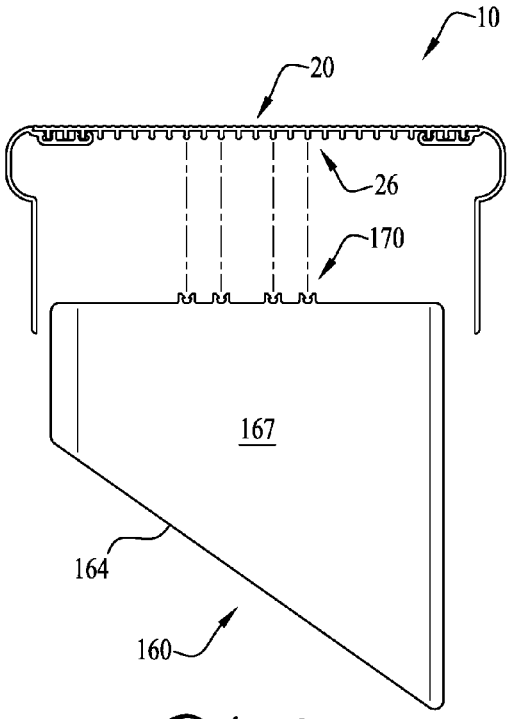
Figure 18:
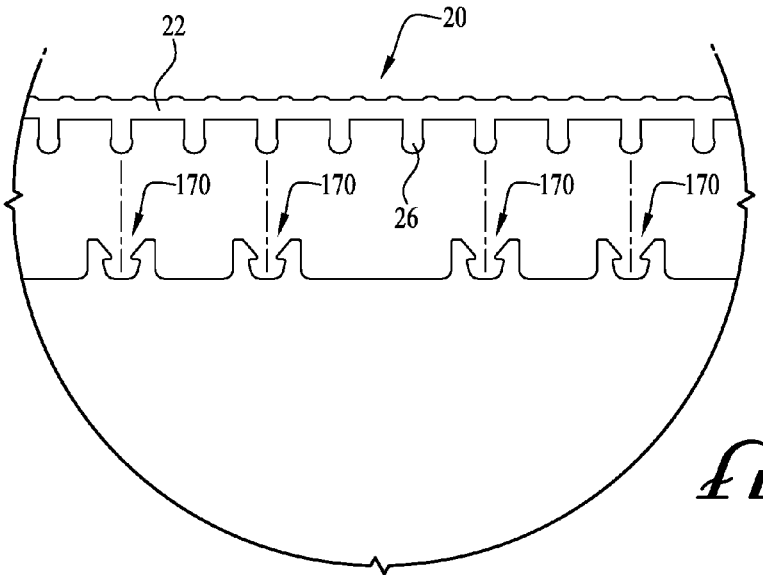
Figure 19:
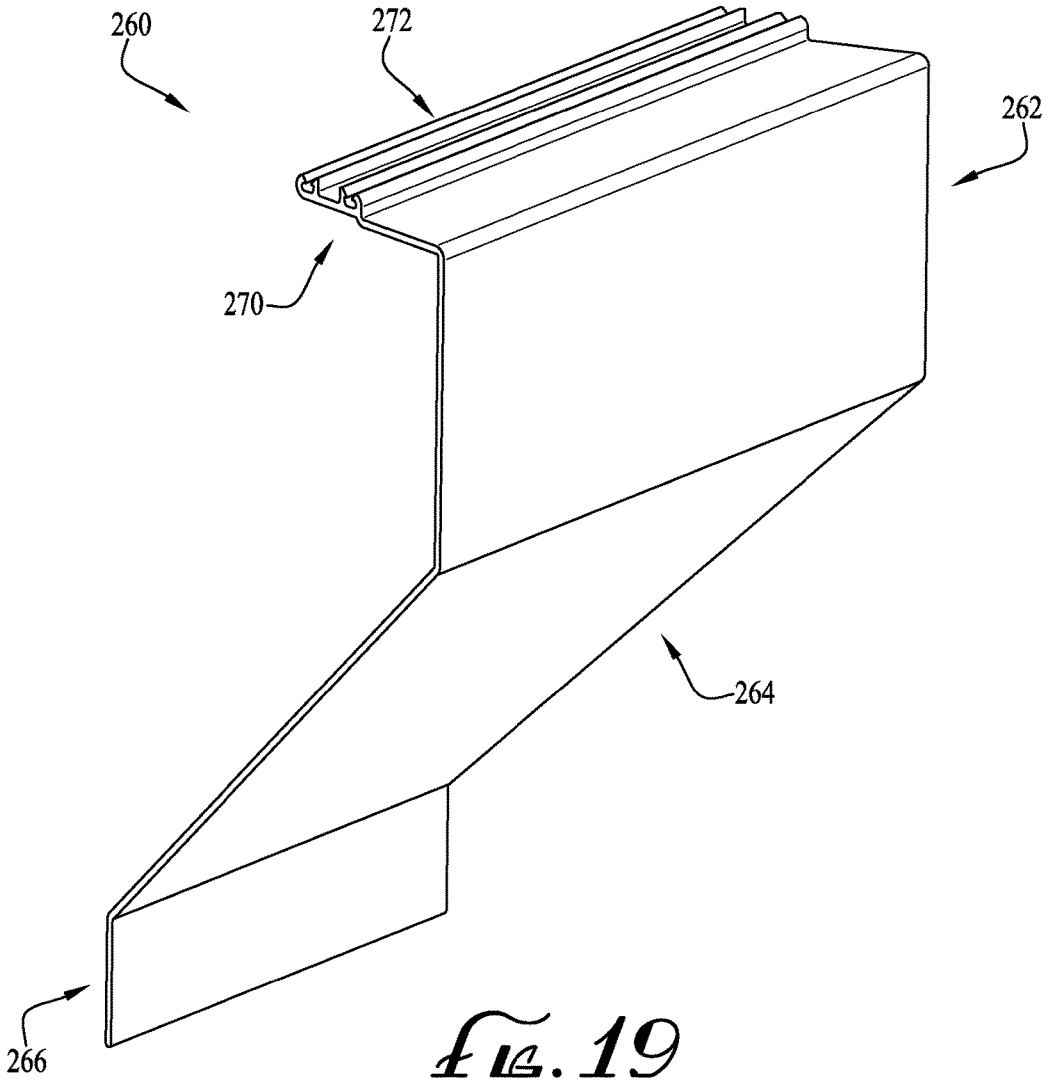
FIG. 19 shows a front perspective view of a wave diverter according to another example embodiment of the present invention.

According to example forms, the top face 62 of the diverter 60 preferably comprises one or more interengagement features substantially similar to the interengagement channels 50 on the side flanges 40 for providing coupling engagement with one or more of the ribs 26 of the panel 20. For example, as depicted in FIGS. 16-18, a top face 162 of the wave diverter 160 comprises a plurality of interengagement features 170 for providing coupling engagement of the wave diverter 160 with one or more ribs 26 of the panel. In preferred example forms, the interengagement features 170 are substantially similar to the interengagement channels of the side flanges 40. According to one form, the top face 162 comprises two sets of oppositely-positioned interengagement features 170 that are generally positioned on opposite ends of the top face 162 of the diverter 160. Optionally, one or more interengagement features may be provided and may be positioned as desired on the top face 162. Preferably, the interengagement features 170 are generally spaced apart a distance that is substantially similar to the spacing of the ribs 26, or an even multiple thereof (e.g., one, two, three, etc. times the spacing distance between the ribs), with sufficient clearance therebetween for any intervening ribs. Alternatively, one or more other portions of the wave diverter may comprise additional interengagement features for providing coupling interengagement with other attachment points of the capping system 10 and/or the wall of sheet pilings SP. Further optionally, one or more separate fasteners, adhesive, glue, or other couplings or fasteners may be provided to attach the wave diverter 60 to the capping system 10 and/or to the wall of sheet pilings SP.

FIGS. 19-24 show a wave diverter 260 according to another example embodiment of the present invention. As depicted, the wave diverter 260 is generally in the form of a generally resilient, flange-like member comprising one or more connected panels, for example, which is preferably capable of being formed by an extrusion or molding process, and which generally couples to a portion of the capping system 10 and/or the sheet pilings SP for generally preventing unintentional disengagement of the capping system from the sheet pilings SP by generally turbulent water flow (e.g., waves, etc.). In example embodiments, the wave diverter can be formed from polyvinyl chloride (PVC), polypropylene, polyethylene, ABS, nylon, steel, aluminum, and/or other plastics, metals or other materials and/or mixtures or composites thereof. According to one example form, the wave diverter 260 is generally formed from a plastic composite comprising glass fibers therein. Optionally other materials (either singly or in combination may be used as desired). According to some example forms, the wave diverter 260 is generally at least partially flexible and substantially resilient for durability and impact resistance. According to other example embodiments, the wave diverter is generally less resilient and generally at least partially foldable (e.g., permanent deformation) to provide for a generally snug fit within the recess R of the sheet pilings SP and with the capping system 10. Preferably, as will be described below, one or more drainage openings can be provided and/or the dimensions of the diverter 260 can be configured to allow clearance for providing the egress of water, for example, such that water is generally not contained within a void defined between the diverter and the recess R (see FIG. 23).

In example embodiments, the waver diverter 260 generally comprises an upper section 262, an intermediate section 264, and a lower section 266, which are generally integrally formed together. In example forms, a connection portion or extension 270 is provided generally adjacent the upper section 262, for example, which comprises one or more interengagement channels 272 for providing interengagement with the ribs 26 of the top panel 20 (as similarly described above), for example, when the wave diverter 260 is generally assembled with the sheet pilings SP and the capping system 10 (see FIG. 24). Generally, the connection portion 270 extends substantially perpendicular relative to the upper section 262 such that the diverter 260 is positioned such that the upper section is oriented along a generally vertical plane.

According to example forms, the upper section 262 comprises a generally planar and rectangular panel 263, the intermediate section 264 generally comprises a generally planar and angled or tapered panel 265, and the lower section 266 generally comprises a generally planar and rectangular panel 267. In example forms, the planar panel 263 is generally parallel to the planar panel 267, and the planar and angled panel 265 is generally angled at an angle $\alpha$ with respect to the planar panels 263, 267. Typically, the angle $\alpha$ is obtuse, for example between about 95-165 degrees, more preferably between about 120-150 degrees, and about 135 degrees according to one example embodiment. Optionally, the angle $\alpha$ can be otherwise configured as desired.

Figure 21:
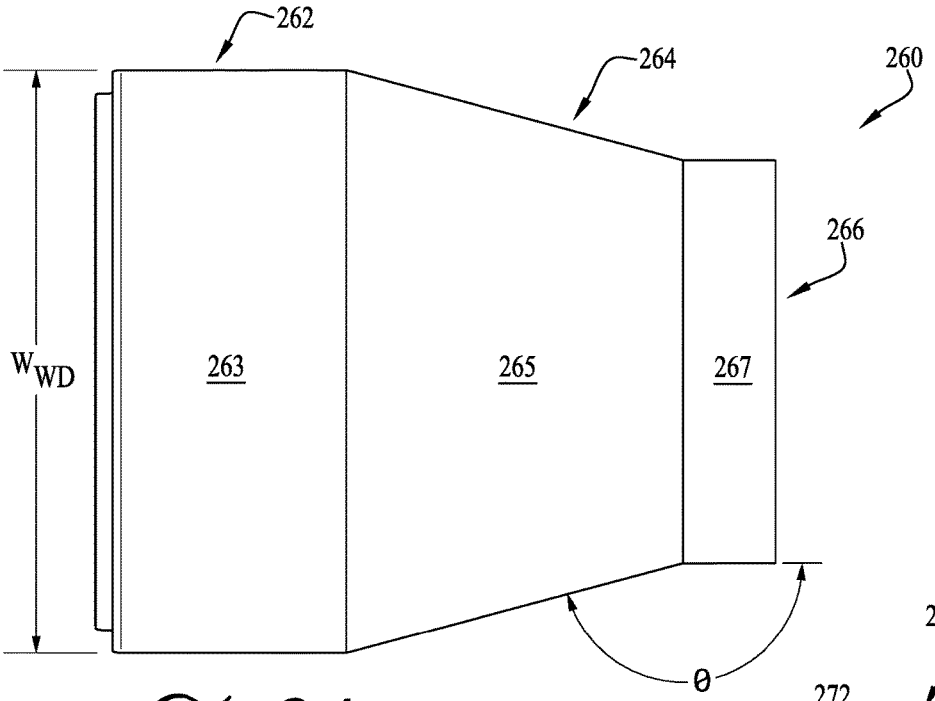
FIGS. 20-22 show a top, a front and a side view, respectively, of the wave diverter of FIG. 19.
Figure 20:
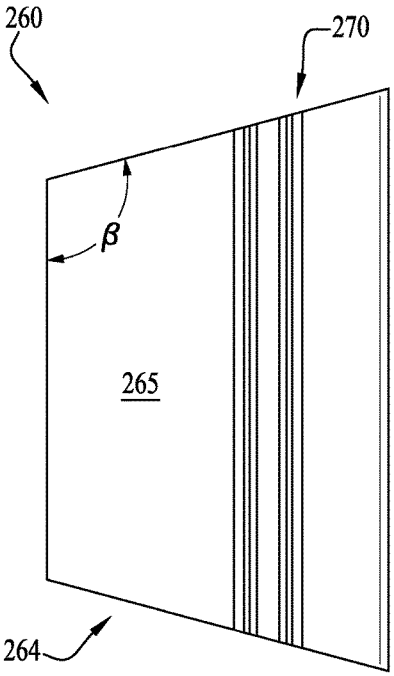
Figure 22:
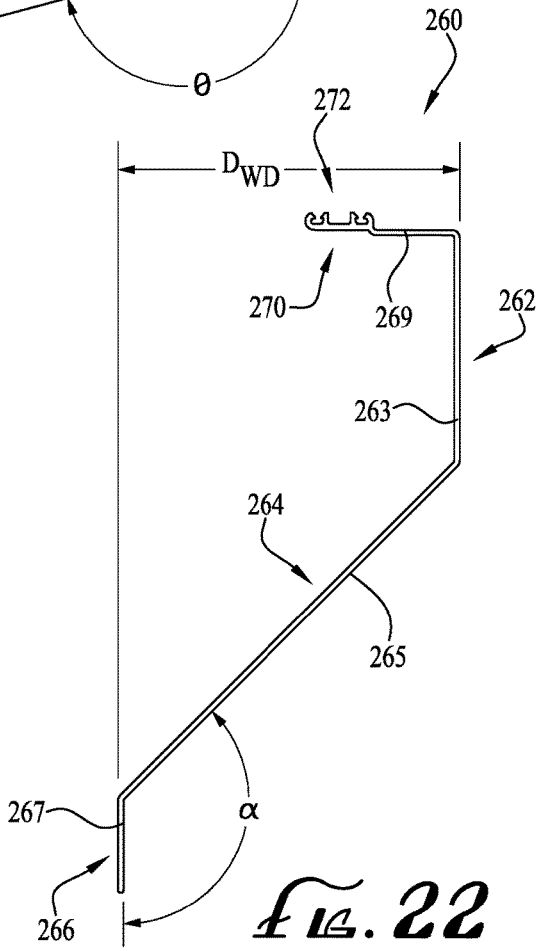

As depicted in FIGS. 20-22, the planar panel 263 of the upper section 262 generally comprises a width $W_{WD}$, and a depth $D_{WD}$ is generally defined between the planar panel 263 of the upper section 262 and the planar panel 267 of the lower section 266. Furthermore, an angle $\beta$ is generally defined at a lower portion of the planar and angled panel 265 (see FIG. 20), and an angle $\theta$ is generally defined between the intersection of the planar panel 267 of the lower section 266 and the angled and planar panel 265 of the intermediate panel 264 (see FIG. 21). Preferably, the width $W_{WD}$, depth $D_{WD}$ and the angles $\beta$ and $\theta$ can be configured as desired, for example, to provide for fitting engagement with the sheet pilings SP. For example, as the sheet pilings SP can be constructed in various sizes and forms (and thus, having recesses of various sizes and shapes), the dimensions as defined herein can preferably be configured for fitting engagement with the various recesses as desired.

In example embodiments, the width $W_{WD}$ is generally between about 5-35 inches, more preferably between about 10-25 inches, for example about 13.75 inches according to one example embodiment. The depth $D_{WD}$ is generally between about 2-20 inches, more preferably between about 5-15 inches, for example about 8.05 inches according to one example embodiment. The angle $\beta$ is generally between about 90-165 degrees, more preferably between about 95-135 degrees, for example about 105 degrees according to one example form. Preferably, as shown in FIG. 20, when viewing a top plan view of the diverter 260, the angle $\beta$ defines the extent at which the sides of the sections 262, 264, 266 extend outwardly, for example, to form a wedge to generally fit within the recess R of the sheet pilings SP. The angle $\theta$ is generally between about 105-180 degrees, more preferably between about 130-175 degrees, for example about 165 degrees according to one example form. In various example embodiments, the width $W_{WD}$, depth $D_{WD}$ and the angles $\alpha$, $\beta$ and $\theta$ can be configured to provide for close fitting engagement with the sheet pilings SP, for example having only a small space therebetween for water drainage.

Figure 23:
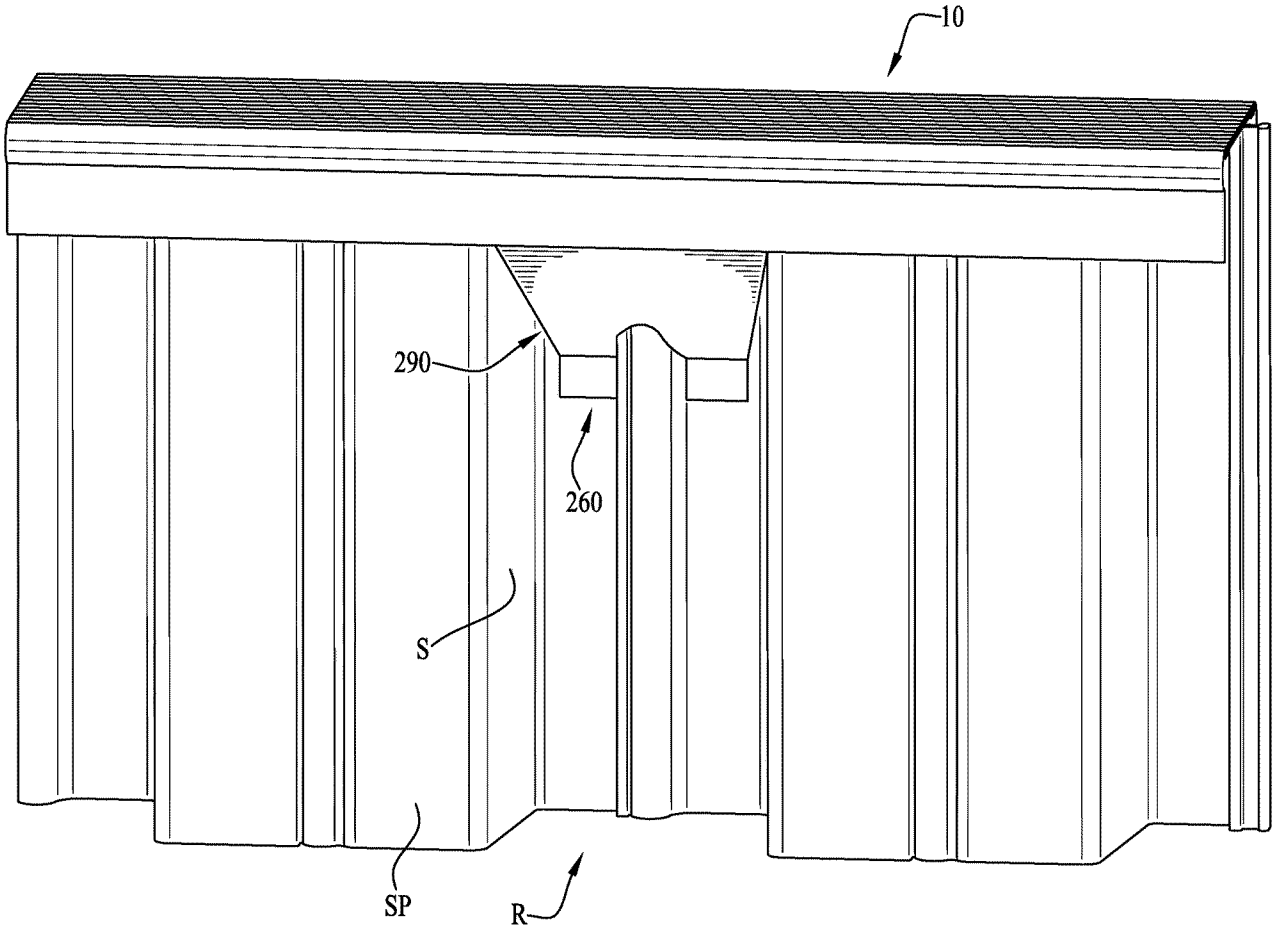
FIG. 23 shows the wave diverter of FIG. 19 assembled with a wall structure comprising a plurality of sheet pilings and the convertible capping system of FIG. 1, and showing the wave diverter positioned within a recess of the sheet pilings.
Figure 24:
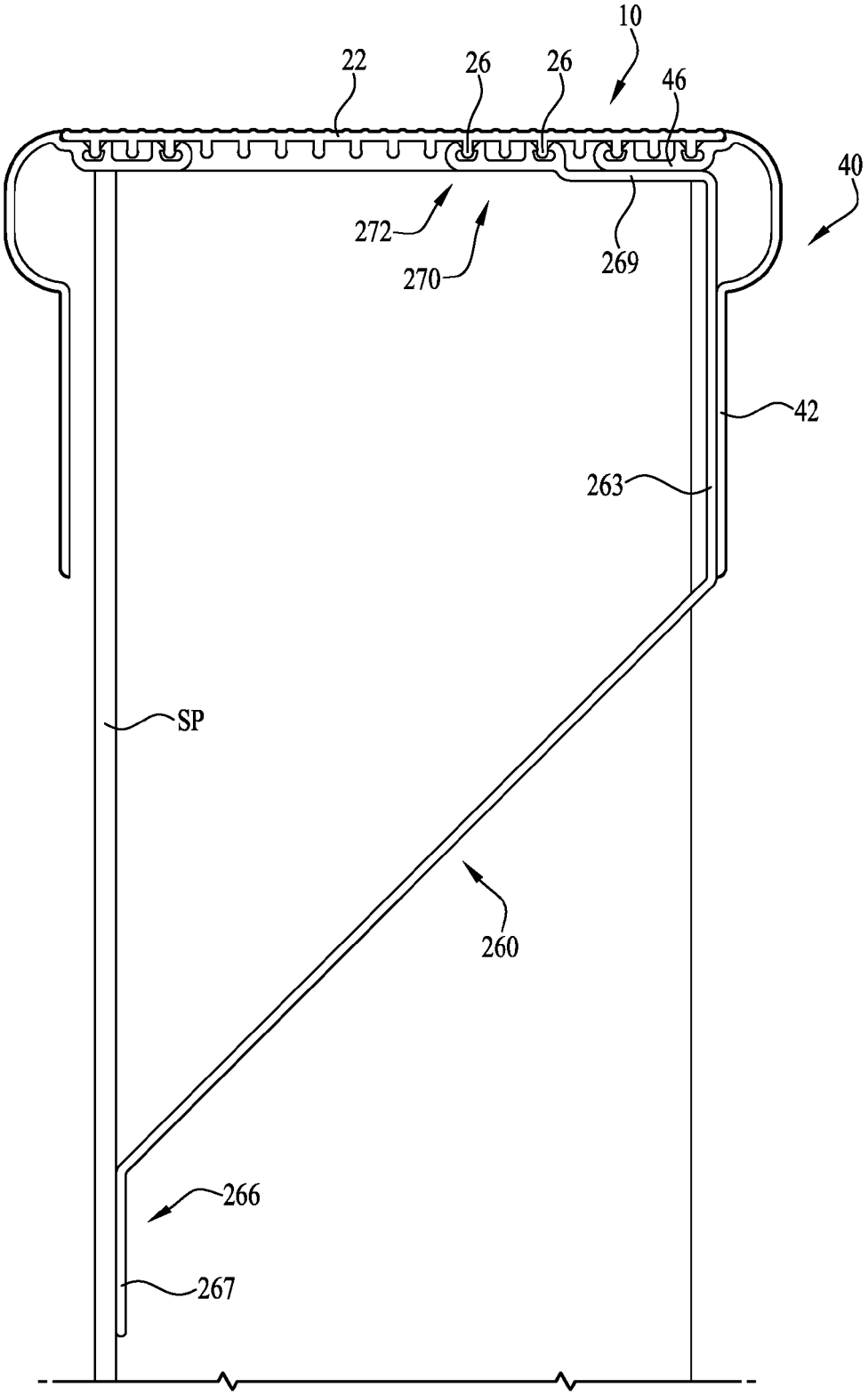
FIG. 24 shows a side plan view of the assembly of FIG. 23.

As depicted in FIG. 24, the wave diverter 260 is generally assembled with the sheet pilings SP and capping system 10. As shown, the interengagement channels 272 of the connection portion 270 are generally interengaged with the ribs 26 of the top panel 20, the leg portion 42 of the flange member 40 is generally seated against or generally adjacent the planar panel 263 of the upper section 262, and the planar panel 267 of the lower section 266 is generally seated against or generally adjacent a surface of the sheet pilings SP. In alternate embodiments, one or more fasteners, adhesive, etc. can be provided for generally securing (removably or permanently) the planar panel 267 to the sheet pilings SP. In some example forms and as depicted in FIG. 23, a gap can be defined between an interior surface S of the recess R and an outer edge of one or both sides of the wave diverter sections (upper, intermediate, lower) for facilitating the flow of water therethrough, for example, such that water or generally turbulent water in contact with the wave diverter 260 can generally flow, drain or generally egress therethrough or therefrom. Thus, the dimensions (e.g., $W_{WD}$, $D_{WD}$, or the angles $\alpha$, $\beta$ and $\theta$) can be configured such that one or more gaps are provided generally between the wave diverter 260 (or portions thereof) and the sheet pilings SP. Furthermore, as depicted in FIG. 23, one or more cutouts or channels, which can be shaped and sized as desired, can be formed through portions of the waver diverter 260 to facilitate fitting engagement of the wave diverter 260 with the sheet pilings SP. For example, similar to the recessed channel 66 of the wave diverter 60, the wave diverter 260 can be configured for generally accommodating fitting engagement of the wave diverter 260 with sheet pilings SP where a transition or generally elongate rib (e.g., defining the connection between two sheet pilings) is present due to the coupling interengagement of the sheet pilings SP. In some forms, the cutout is generally U-shaped and is generally formed through a portion of the lower section 266 and a portion of the intermediate section 264. Optionally, cutouts of other shapes and sizes can for formed as desired. Furthermore, one or more openings can preferably be provided and generally extend through one or more portions of the diverter 260, for example, the intermediate section or other portions of the diverter 260. In some forms, one or more openings can generally extend through the angled and planar panel 265 to facilitate the flow and drainage of water.

In some example forms, an extension member 269 generally extends and integrally connects the connection portion 270 to the planar panel 263 of the upper section 262. In example form, the transition between the extension member 269 and the connection portion 270 is generally stepped, for example, to accommodate the connection portion 270 extending below the connection arm 46 of the flange member 40 and coupling with ribs 26 of the top panel 20. For example, as the connection arm 46 is generally coupled to ribs 26 of the top panel 20 (generally positioned adjacent a side of the top panel 20), the connection portion 270 is generally configured for engagement with ribs 26 of the top panel 20 that are generally positioned a distance from the ribs 26 engaged with the connection arm 46 and generally towards a central portion of the top panel 20.

Figure 25:
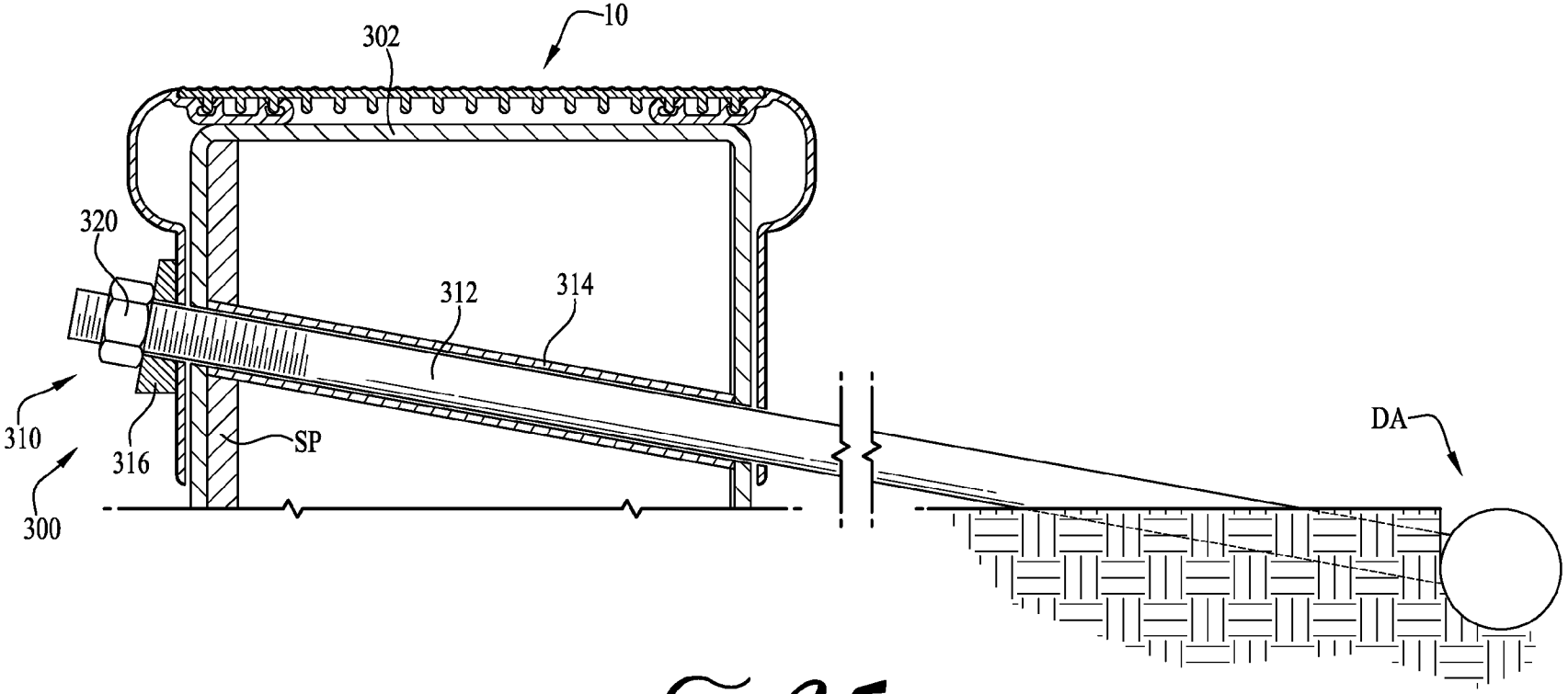
FIG. 25 shows a cross-sectional view of a wall structure comprising a convertible capping system, a structural member and a fastening or anchoring assembly according to another example embodiment of the present invention.

FIG. 25 shows another example embodiment of a capping system according to the present invention, which provides for structurally securing the barrier wall (e.g., sheet pilings SP and assembled capping system 10) to the ground surface or a land mass generally near the barrier wall. According to example form, a fastening system 300 can include a structural member 302 and a fastening system 310, for example, so that the structural member 302 generally provides additional rigidity to the barrier wall (e.g., sheet pilings SP and capping system 10) such that the fastening system 310 substantially anchors the barrier wall against an adjacent land mass or a dead-man anchor DA. In example forms, the structural member 302 is generally U-shaped or C-shaped and formed from a substantially rigid material, for example, a metal (aluminum, steel, etc.), a composite (fiberglass, carbon fiber, etc.), a plastic or other generally rigid or structural material. The structural member 302 is generally fitted on top of the sheet pilings SP and the capping system 10 is positioned atop the structural member 302 (see FIG. 25). According to example forms, the structural member 302 can generally be roll formed to provide the U-shaped cross section, or may be shaped as desired to generally fit atop the sheet pilings SP.

The fastening assembly 310 is generally provided for extending crosswise through a portion of the structural member 302, capping system 10 and the sheet pilings SP, and connected to a dead-man anchor DA such that the fastening assembly 310 generally provides a structural reinforcement to the barrier wall to maintain structural integrity and substantial reinforcement. In example forms, the fastening assembly 310 generally comprises a generally elongate bolt or tie rod 312, a sleeve 314 for generally fitting between inside surfaces of the structural member 302, a washer 316, and a nut 320 for providing threaded engagement with the bolt 312. In example forms, the sleeve 314 is generally fitted between the inside surfaces of the structural member 302 such that a substantial force applied to the bolt (e.g., when the nut 320 is tightened on the bolt 312) does not cause failure or bending of the structural member 302 (or sheet pilings SP). According to one example form, the fastening assembly 310 is generally configured to be generally angled with respect to the generally vertical extension and positioning of the barrier wall. Thus, according to example forms, the sleeve 314 and washer 316 can be configured to comprise one or more angled ends or faces to accommodate the angled extension of the fastening assembly 310.

According to another example embodiment, the present invention relates to a wall barrier retention assembly including one or more sheet pilings generally coupled together to form a wall, and a convertible capping system for capping a top portion of the wall. The convertible capping system generally comprises the top panel and the pair of side flanges. The top panel includes a top side and a bottom side, and wherein the bottom side comprises the plurality of engagement ribs. The pair of side flanges are generally configured for coupling to the top panel, and wherein the side flanges each have at least one engagement channel for engagement with the engagement ribs of the bottom side of the top panel. Optionally, as described above, the structural member and/or the fastening assembly can be provided with the wall barrier retention assembly. Preferably, the capping system 10 provides a universal fit with walls of differing widths, whereby the user can fit (e.g., trim) the cap to any of a plurality of different walls.

In further embodiments, the present invention relates to method of using a convertible width capping system for capping the top portion of a barrier wall, the method comprising providing a convertible capping system comprising at least one top panel with a width that can be modified, and a pair of side flanges configured for engagement with the top panel; determining the width of the barrier wall and trimming the at least one top panel to conform the capping system to the width of the barrier wall; coupling the pair of side flanges to the trimmed top panel to form the convertible capping system; and mounting the convertible capping system to the top of the barrier wall. Optionally, the method further comprises attachment of one or more wave diverters to the wall, for example by engagement of cooperative engagement features of the diverter and the top plate of the capping system.

While the capping system and method have been described herein with reference to example embodiments configured for application to a sheet piling wall or other structure formed of sheet pilings, in alternate forms the capping system and method may be adapted for application to various other forms of walls and structures including or not including sheet piling components.

While the invention has been described with reference to preferred and example embodiments, it will be understood by those skilled in the art that a variety of modifications, additions and deletions are within the scope of the invention, as defined by the following claims.

What is claimed is:

1. A capping system for capping a top portion of a wall, the capping system comprising:

a top panel comprising a top side and a bottom side, the bottom side comprising a plurality of engagement ribs; and a pair of side flanges for coupling to the top panel, the side flanges each comprising a connection flange portion comprising at least one engagement channel for engagement with the engagement ribs of the bottom side of the top panel, and a front panel portion configured to overlie an exterior face of the wall.

2. The capping system of claim 1, wherein the wall comprises a sheet piling wall.

3. The capping system of claim 2, wherein the sheet piling wall comprises a first width, and wherein the pair of side flanges defines a second width therebetween, and wherein the first width is generally similar to or generally less than the second width.

4. The capping system of claim 1, wherein the engagement between the side flanges and the top panel is removable.

5. The capping system of claim 1, wherein the engagement between the side flanges and the top panel is permanent.

6. The capping system of claim 1, further comprising a wave diverter for removable engagement with a portion of the capping system.

7. The capping system of claim 6, wherein the wave diverter comprises one or more interengagement features for engagement with one or more of the engagement ribs of the top panel.

8. The capping system of claim 7, wherein the wave diverter is sized and shaped to be positioned against a portion of the wall and generally within a recess thereof, and wherein the wave diverter is configured for removable engagement with the bottom side of the top panel.

9. The capping system of claim 7, wherein the wave diverter is generally wedge-shaped, wherein each side of the diverter is tapered at an angle of between about 95-135 degrees relative to a horizontal plane.

10. The capping system of claim 7, wherein the wave diverter comprises a width and a depth, wherein the width is generally between about 10-21 inches and the depth is generally between about 5-15 inches.

11. The capping system of claim 6, wherein the wave diverter inhibits flows of water and/or waves from causing unintentional disengagement of portions of the capping system itself and/or the capping system from the wall.

12. The capping system of claim 1, further comprising a structural member configured for mounting atop the wall, and wherein the assembled top panel and side flanges are configured to mount over the structural member.

13. The capping system of claim 12, wherein the structural member is generally U-shaped.

14. The capping system of claim 12, further comprising a fastening system for structurally reinforcing the wall.

15. The capping system of claim 14, wherein the fastening system comprises a tie rod, a sleeve, a washer and a nut, and wherein a distal end portion of the tie rod is coupled to a dead man anchor.

16. A sheet piling wall assembly comprising:

a plurality of sheet piling members assembled together to form a wall;

a convertible capping system for capping a top portion of the wall, the convertible capping system comprising a top panel and a pair of side flanges, the top panel comprising a top side and a bottom side, the bottom side comprising a plurality of engagement ribs, and the pair of side flanges configured for coupling to the top panel, the side flanges each comprising a connection flange portion comprising at least one engagement channel for engagement with the engagement ribs of the bottom side of the top panel, and a front panel portion configured to overlie an exterior face of the wall.

17. The sheet piling wall assembly of claim 16, further comprising a structural member for placement atop the top portion of the wall.

18. The sheet piling wall assembly of claim 17, wherein the structural member is generally U-shaped.

19. The sheet piling wall assembly of claim 17, wherein the structural member is positioned atop the top portion of the wall, and wherein the convertible capping system is positioned atop the structural member.

20. The sheet piling wall assembly of claim 17, further comprising a fastening assembly for generally securing the wall with a dead man anchor that is secured in a ground surface adjacent the wall.

21. The sheet piling wall assembly of claim 20, wherein the fastening assembly comprises a tie rod, a sleeve for fitting between the structural member, a washer, and a threaded nut.

22. The sheet piling wall assembly of claim 16, further comprising a wave diverter for removable engagement with a portion of the convertible capping system.

23. The sheet piling wall assembly of claim 22, wherein the wave diverter comprises at least one interengagement feature for engagement with one or more of the engagement ribs of the top panel.

24. The sheet piling wall assembly of claim 23, wherein the wave diverter is sized and shaped to be positioned against a portion of the wall and generally within a recess thereof, and wherein the wave diverter is configured for removable engagement with the bottom side of the top panel.

25. The sheet piling wall assembly of claim 24, wherein the wave diverter inhibits waves from causing unintentional disengagement of portions of the capping system itself and/or the capping system from the wall.

26. The sheet piling wall assembly of claim 24, wherein the wave diverter is generally wedge-shaped, and wherein each side of the diverter is tapered at an angle of between about 95-135 degrees relative to a horizontal plane.

27. The sheet piling wall assembly of claim 24, wherein the wave diverter comprises a width and a depth, wherein the width is generally between about 10-21 inches and the depth is generally between about 5-15 inches.

28. A method of capping a top portion of a wall comprising:

providing a top panel and a pair of side flanges, wherein the top panel comprises a top side and a bottom side, the bottom side comprising a plurality of engagement ribs, and wherein the side flanges each comprise a connection flange portion comprising at least one engagement channel for engagement with the engagement ribs of the bottom side of the top panel, and a front panel portion configured to overlie an exterior face of the wall;

coupling the engagement channel of the side flanges to at least one of the engagement ribs of the top panel to form a wall capping system having a width corresponding to a thickness of the wall; and mounting the capping system to a top portion of the wall with the front panel portions of the side flanges overlying exterior faces of the wall.

29. The method of claim 28, wherein the wall comprises a sheet piling wall.

30. The method of claim 28, wherein the top panel has an initial width, and wherein the method further comprises cutting the top panel to a final width less than the initial width, the final width producing the width of the wall capping system corresponding to a thickness of the wall.

31. A capping system for capping a top portion of a wall, the capping system comprising:

a top panel comprising a top side and a bottom side, the bottom side comprising a plurality of engagement ribs;

a pair of side flanges for coupling to the top panel, the side flanges each comprising at least one engagement channel for engagement with the engagement ribs of the bottom side of the top panel; and a wave diverter comprising interengagement features for engagement with the engagement ribs of the top panel.

32. The capping system of claim 31, wherein the wall comprises a sheet piling wall.

33. The capping system of claim 31, wherein the wave diverter is sized and shaped to be positioned against a portion of the wall and generally within a recess thereof, and wherein the wave diverter is configured for removable engagement with the bottom side of the top panel.

34. The capping system of claim 31, wherein the wave diverter inhibits flows of water and/or waves from causing unintentional disengagement of portions of the capping system itself and/or the capping system from the wall.

35. The capping system of claim 31, wherein the wave diverter is generally wedge-shaped, wherein each side of the diverter is tapered at an angle of between about 95-135 degrees relative to a horizontal plane.

36. The capping system of claim 31, wherein the wave diverter comprises a width and a depth, wherein the width is generally between about 10-21 inches and the depth is generally between about 5-15 inches.

37. A sheet piling wall assembly comprising:

a plurality of sheet piling members assembled together to form a wall;

a convertible capping system for capping a top portion of the wall, the convertible capping system comprising a top panel and a pair of side flanges, the top panel comprising a top side and a bottom side, the bottom side comprising a plurality of engagement ribs, and the pair of side flanges configured for coupling to the top panel, the side flanges each comprising at least one engagement channel for engagement with the engagement ribs of the bottom side of the top panel; and a wave diverter comprising at least one interengagement feature for engagement with one or more of the engagement ribs of the top panel.

38. The sheet piling wall assembly of claim 37, wherein the wave diverter is sized and shaped to be positioned against a portion of the wall and generally within a recess thereof, and wherein the wave diverter is configured for removable engagement with the bottom side of the top panel.

39. The sheet piling wall assembly of claim 38, wherein the wave diverter inhibits waves from causing unintentional disengagement of portions of the capping system itself and/or the capping system from the wall.

40. The sheet piling wall assembly of claim 38, wherein the wave diverter is generally wedge-shaped, and wherein each side of the diverter is tapered at an angle of between about 95-135 degrees relative to a horizontal plane.

41. The sheet piling wall assembly of claim 38, wherein the wave diverter comprises a width and a depth, wherein the width is generally between about 10-21 inches and the depth is generally between about 5-15 inches.

* * * * *